US006568360B2

(12) United States Patent
Cristiani et al.

(10) Patent No.: US 6,568,360 B2
(45) Date of Patent: May 27, 2003

(54) ELECTROHYDRAULIC DEVICE FOR OPERATING THE VALVES OF A COMBUSTION ENGINE

(75) Inventors: Marcello Cristiani, Imola (IT); Nicola Morelli, Rende (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 0 days.

(21) Appl. No.: 10/078,160

(22) Filed: Feb. 20, 2002

(65) Prior Publication Data

US 2002/0124818 A1 Sep. 12, 2002

(30) Foreign Application Priority Data

Feb. 20, 2001 (IT) ..... BO01A0092

(51) Int. Cl.[7] ..... F01L 9/02

(52) U.S. Cl. ..... 123/90.12; 123/90.13; 251/30.01

(58) Field of Search ..... 123/90.12, 90.13; 251/48, 30.01, 47

(56) References Cited

U.S. PATENT DOCUMENTS 5,224,683 A * 7/1993 Richeson ..... 251/30.01
5,339,777 A 8/1994 Cannon
5,865,156 A 2/1999 Feucht et al.
5,881,689 A 3/1999 Hochholzer

FOREIGN PATENT DOCUMENTS

DE 21 51 331 A 4/1973

* cited by examiner

*Primary Examiner*—Thomas Denion
*Assistant Examiner*—Kyle Riddle
(74) *Attorney, Agent, or Firm*—Venable LLP; Robert Kinberg; Catherine M. Voorhees

(57) ABSTRACT

Electrohydraulic device for operating an intake or exhaust valve of a combustion engine; the electrohydraulic device comprises a linear hydraulic actuator designed to move the valve axially from a closed position to a maximum opening position, and an electronic control hydraulic distributor designed to regulate the flow of pressurized liquid from and towards the linear hydraulic actuator in order to control movement of the above-mentioned valve between the closed and maximum opening positions; the electronic control hydraulic distributor comprises a slide valve which, by selection, can be set to three positions: a first operating position in which it establishes direct communication between the linear hydraulic actuator and an outlet of the pressurized liquid, a second operating position in which it isolates the linear hydraulic actuator in such a way as to prevent the flow of pressurized liquid from or towards the actuator, and a third operating position which establishes direct communication between the linear hydraulic actuator and an inlet of the pressurized liquid.

7 Claims, 3 Drawing Sheets

ELECTROHYDRAULIC DEVICE FOR OPERATING THE VALVES OF A COMBUSTION ENGINE

CROSS REFERENCE TO RELATED APPLICATION

This application claims the priority of Italian Application No. BO2001A 000092 filed Feb. 20, 2001, the disclosure of which is being incorporated herein by reference.

BACKGROUND OF THE INVENTION

The present invention concerns an electrohydraulic device for operating the valves of a combustion engine.

As is known, combustion engines are currently being tested out in which the intake and exhaust valves that selectively establish communication between the engine combustion chamber and the engine intake and exhaust manifolds respectively are operated by electrohydraulic devices driven by an electronic control unit.

This solution permits very accurate variation of the opening and closing moments of the valves according to the angular speed of the crankshaft and other engine operating parameters, considerably increasing engine efficiency.

In greater detail, combustion engines are currently being tested out provided with an electrohydraulic operating device for each engine intake and/or exhaust valve; said device comprises a linear hydraulic actuator designed to move the valve axially from the closed position to the maximum opening position, overcoming the action of an elastic element designed to maintain the valve in the closed position, and an electronic control hydraulic distributor designed to regulate the flow of pressurized oil from and towards the hydraulic actuator, in such a way as to control movement of the valve between the closed and maximum opening position.

To satisfy pressurized oil requirements, the combustion engines currently being tested are furthermore provided with a hydraulic circuit that comprises an oil collection tank, inside which the oil to be conveyed to the actuators is stored at ambient pressure, and a pumping unit designed to convey pressurized oil to the various hydraulic distributors, taking it directly from the collection tank.

Each electronic control hydraulic distributor is connected to the hydraulic circuit in such a way as to establish direct communication, respectively, between the corresponding linear hydraulic actuator and the pumping unit delivery inlet when it is necessary to move the valve from the closed position to the maximum opening position, and the collection tank when it is necessary to move the valve from the maximum opening position to the closed position. In the first case, the pressurized oil is conveyed into the linear hydraulic actuator whereas in the second case the pressurized oil that fills the linear hydraulic actuator is conveyed directly into the collection tank.

In other words, therefore, all the pressurized oil conveyed inside the hydraulic actuator during movement of the valve from the closed position to the maximum opening position is discharged directly into the collection tank during movement of the valve from the maximum opening position to the closed position, propelled by the elastic element designed to keep the valve in the closed position.

The main disadvantage of the solution described above is the considerable amount of pressurized oil required which increases proportionally to the engine rpm, and which calls for the use of pumping units that are so bulky as to be incompatible with use in automotive applications.

To solve the above problem, the applicant has developed and patented a combustion engine in which the electrohydraulic operating device is able to re-convey, during movement of the valve from the maximum opening position to the closed position, the majority of the pressurized oil present inside the hydraulic actuator into the high pressure part of the hydraulic circuit, exploiting the elastic energy accumulated by the elastic element designed to keep the valve in the closed position.

In other words, the linear hydraulic actuator and the corresponding electronic control hydraulic distributor are constructed and driven in such a way as to re-pump, during movement of the valve from the maximum opening position to the closed position, the majority of the pressurized oil present inside the hydraulic actuator into the high pressure part of the hydraulic circuit, exploiting the elastic energy accumulated by the elastic element designed to keep the valve in the closed position.

In this way, the overall pressurized oil requirements are drastically reduced, making it possible to use small pumping units compatible with automotive use. The pressurized oil re-pumped by each linear hydraulic actuator into the high pressure part of the hydraulic circuit can be immediately reused.

Unfortunately, the last solution described above requires the use of particularly complicated electrohydraulic devices which are not currently compatible with the automotive sector due to cost and reliability.

SUMMARY OF THE INVENTION

The aim of the present invention is to produce an electrohydraulic device to operate the valves of a combustion engine which is more reliable and cheaper to produce than those currently known, so that it can be effectively used in the automotive sector.

According to the present invention, an electrohydraulic device is produced for the operation of at least one intake or exhaust valve of a combustion engine; the electrohydraulic device comprises a linear hydraulic actuator, which is designed to move said valve axially from a closed position to a maximum opening position, and an electronic control hydraulic distributor designed to regulate the flow of pressurized liquid from and towards the linear hydraulic actuator, in such a way as to control movement of said valve between said closed and maximum opening positions; the electrohydraulic device is characterized in that said electronic control hydraulic distributor comprises a slide valve which, by selection, can be set to a first operating position in which it establishes direct communication between said linear hydraulic actuator and an outlet of the pressurized liquid, a second operating position in which it isolates said linear hydraulic actuator in such a way as to prevent the flow of pressurized liquid from or towards the actuator, and a third operating position in which it establishes direct communication between said linear hydraulic actuator and an inlet of the pressurized liquid.

BRIEF DESCRIPTION OF THE DRAWINGS

The present invention will now be described with reference to the attached drawings which illustrate a non-restrictive implementation example in which:

FIG. 2 is an enlarged view, with parts in section and parts removed for clarity, of one of the electrohydraulic devices for driving the valves of a combustion engine illustrated in FIG. 1; while

DETAILED DESCRIPTION OF THE INVENTION

Figure 1:
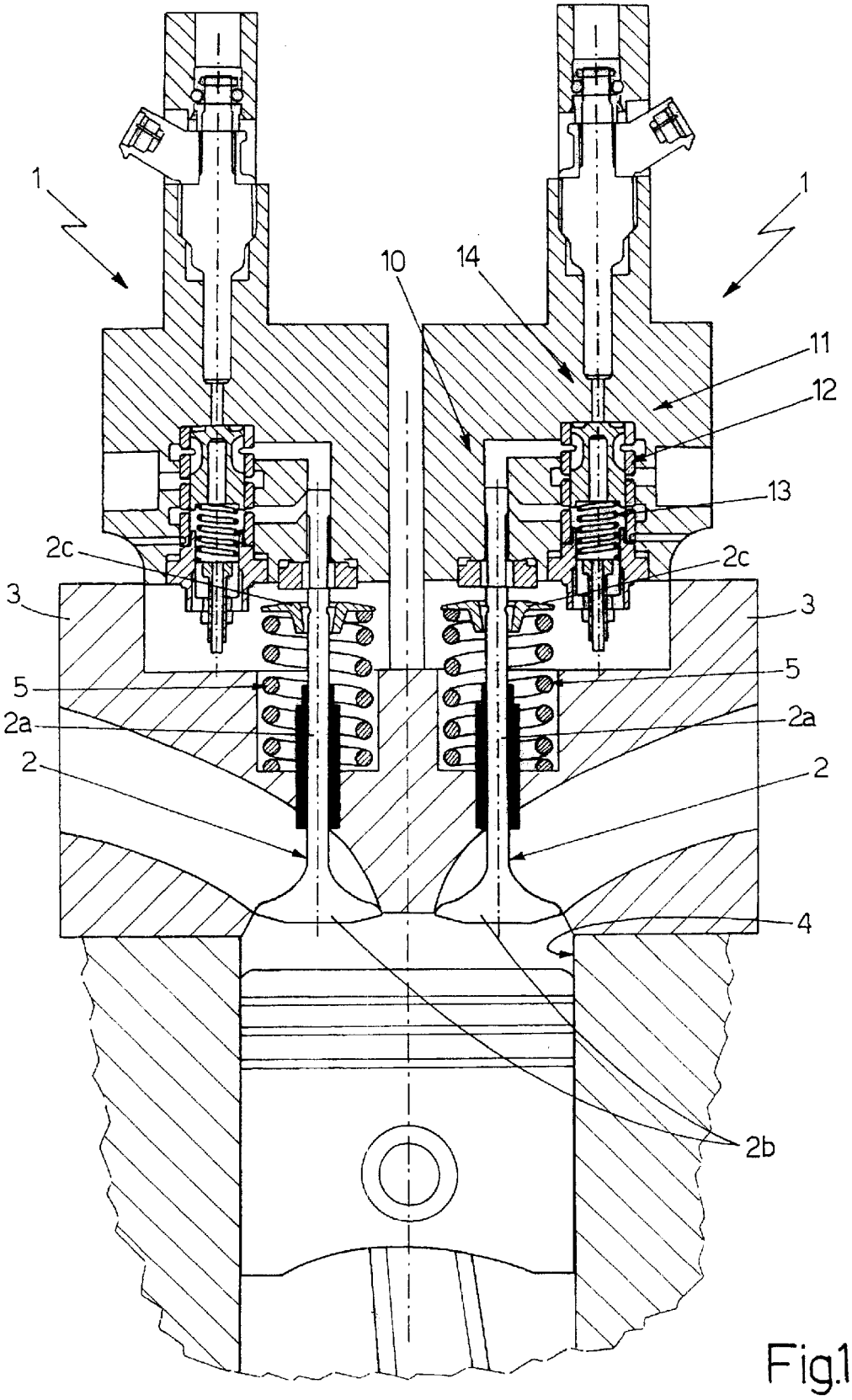
FIG. 1 illustrates schematically, with parts in section and parts removed for clarity, a combustion engine equipped with electrohydraulic devices for operation of the valves constructed according to the present invention.
Figure 2:
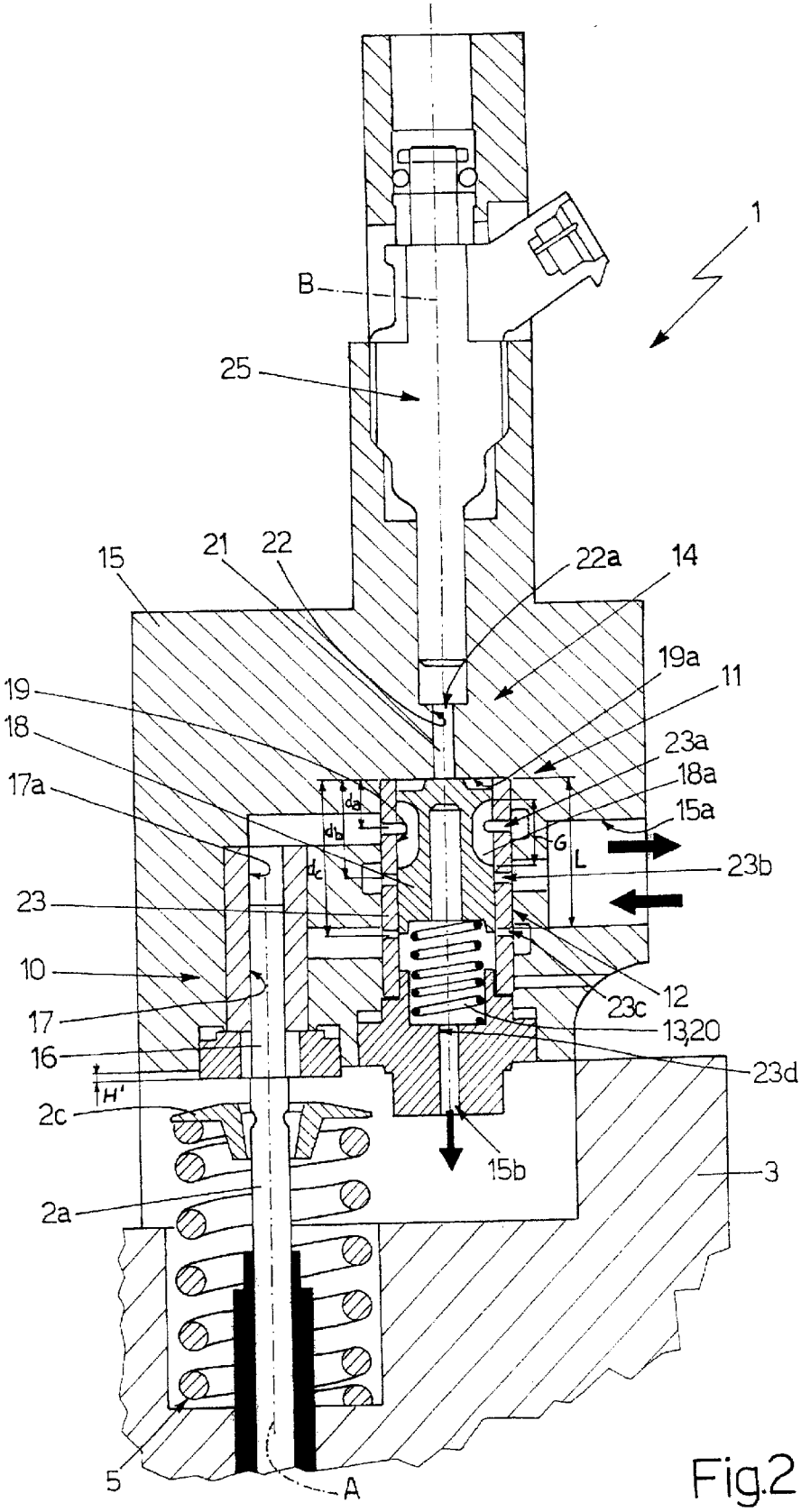

With reference to FIGS. 1 and 2, number 1 indicates overall an electrohydraulic device designed to move by command at least one intake or exhaust valve 2 of a combustion engine.

As is known, in fact, any combustion engine currently comprises: an engine block, one or more pistons fitted axially and sliding inside respective cylindrical cavities made in the body of the engine block, and a head 3 positioned at the top of the engine block to close the above-mentioned cylindrical cavities.

Together with the head 3, each piston defines, inside the respective cylindrical cavity, a variable volume combustion chamber 4 which is connected to the engine intake manifold and exhaust manifold (both of known type and not illustrated) via at least one intake pipe and at least one exhaust pipe respectively, both made in the body of the head 3; the combustion engine furthermore comprises a series of intake and exhaust valves 2 designed to regulate the flow of air or burnt gases flowing from and towards each combustion chamber 4 via the corresponding intake pipe and the corresponding exhaust pipe.

In greater detail, the intake and exhaust valves 2 are positioned in the head 3 corresponding to the inlet of each intake pipe and each exhaust pipe, and move between a closed position, in which they prevent passage of the gases through the intake or exhaust pipe from and towards the combustion chamber 4, and a maximum opening position, in which they permit passage of the gases through the intake or exhaust pipe from and towards the combustion chamber with the maximum flow rate possible.

For each valve 2, the combustion engine also comprises a respective elastic element 5 designed to keep the valve 2 in the closed position.

With reference to FIG. 1, in the example illustrated, each intake or exhaust valve 2 is mushroom-shaped and fitted on the head 3 of the engine with its stem 2*a* sliding axially through the body of the head 3 and its head 2*b* moving axially at the intake or exhaust pipe inlet, in such a way as to move between a closed position, in which the head 2*b* of the valve 2 prevents passage of the gases through the intake or exhaust pipe from and towards the combustion chamber 4, and a maximum opening position in which the head 2*b* of the valves 2 protrudes inside the combustion chamber 4, in such a way as to permit passage of the gases through the intake or exhaust pipe from and towards the combustion chamber 4 with the maximum flow rate possible.

As regards the elastic element 5, it consists of a compression pre-loaded helical spring 5 fitted on the stem 2*a* of the valve 2 so that the first end stops against the head 3 of the engine and the second end stops against a locating ring nut 2*c* integral with the stem 2*a* of the valve 2 itself.

With reference to FIGS. 1 and 2, the electrohydraulic device 1 for operation of the valves 2 is provided with an inlet, via which the pressurized oil is supplied to the electrohydraulic device 1, and an outlet via which the pressurized oil flows out of the electrohydraulic device 1, and comprises a linear hydraulic actuator 10, designed to move the valve 2 axially from the closed position to the maximum opening position, overcoming the action of the elastic element 5, and an electronic control hydraulic distributor 11 designed to regulate the flow of pressurized oil from and towards the hydraulic actuator 10, so that it controls movement of the valve 2 between said closed and maximum opening positions.

The linear hydraulic actuator 10 consists, in the example illustrated, of a simple single-acting hydraulic piston while the hydraulic distributor 11 comprises: a slide valve 12, selectively able to establish direct communication between the hydraulic actuator and the pressurized oil inlet or the pressurized oil outlet, or isolate the hydraulic actuator 10 from both inlet and outlet; an elastic element 13 designed to keep the slide valve 12 in a first operating position, in which the valve itself establishes direct communication between the linear hydraulic actuator 10 and the pressurized oil outlet; and an electric control actuator 14 designed to move, by command, the slide valve 12 from the first operating position, overcoming the action of the elastic element 13.

In greater detail, the electric control actuator 14 is designed to move, by command, the slide valve 12 from a first operating position to a second operating position, in which the slide valve 12 isolates the linear hydraulic actuator 10 from the pressurized oil inlet and outlet, passing through a third operating position in which the valve establishes direct communication between the linear hydraulic actuator 10 and the pressurized oil inlet.

With reference to FIGS. 1 and 2, in the example illustrated, the linear hydraulic actuator 10 and the hydraulic distributor 11 are integrated in one single structure, and the electrohydraulic device 1 therefore comprises:

- an outer casing 15 designed to be fixed to the head 3 immediately above the intake or exhaust valve 2 operated by the electrohydraulic device 1;
- a piston 16, fitted axially to slide inside a cylindrical cavity 17 that extends inside the outer casing 15 so that it is coaxial with the axis A of the stem of the valve 2;
- a slider 18 fitted axially to slide inside a cylindrical cavity 19 that extends inside the outer casing 15 beside the cylindrical cavity 17, so that it is coaxial with an axis B preferably but not necessarily parallel to the axis A;
- a helical spring 20 coaxial with the axis B inside the cylindrical cavity 19 with the two ends stopping, respectively, against one of the two end surfaces of the cavity and against the axial end of the slider 18, in order to keep the latter positioned firmly against the other end surface of the cylindrical cavity 19, hereinafter referred to by number 19*a*; and finally
- a second piston 21, fitted axially to slide inside a cylindrical cavity 22 which extends inside the outer casing 15 coaxially to axis B, from the end surface of the cylindrical cavity 19 against which the slider 18 is pushed by the helical spring 20, or from the end surface 19*a*.

With reference to FIG. 2, the cylindrical cavity 17 communicates directly with the outside so that it faces the upper end of the stem 2*a* of the valve 2, and the piston 16 is fitted in the cylindrical cavity 17 so that it protrudes partially outside the cavity, or the outer casing 15, thus positioning itself and remaining always with one end against the upper end of the stem 2*a* of the valve 2.

The piston 16, furthermore, is fitted to move inside the fluid-tight cylindrical cavity 17, creating inside the latter a variable volume chamber 17*a* selectively designed to be filled with pressurized oil. This pressurized oil is able to exert on the piston 16 a sufficient force to overcome the action of the elastic element 5, and to axially move the piston 16 from a retracted position, in which it protrudes outside the cylindrical cavity 17 by a set length H', to an extended position in which it protrudes outside the cylindrical cavity 17 by a set length H", greater than H'.

It should be noted that the piston 16, or the linear hydraulic actuator 10, since it is always positioned against the upper end of the stem 2*a* of the valve 2, when it is in the retracted position sets the valve 2 to the closing position whereas when it is in the extended position, it sets the valve 2 to the maximum opening position. The difference between the lengths H' and H" corresponds to the stroke or lift of the valve 2.

As regards the hydraulic distributor 11 and in particular the slide valve 12, the cylindrical cavity 19 is provided with a series of exhaust ports which communicate, via a series of connection pipes made in the body of the outer casing 15, with the pressurized oil inlet 15*a* and with the pressurized oil outlet 15*b*, both made in the body of the outer casing 15, and with the variable volume chamber 17*a* inside the cylindrical cavity 17 respectively. As regards the slider 18, it is fitted axially to slide inside the cylindrical cavity 19 in such a way as to obstruct, according to its position inside the cavity, one or more of the above exhaust ports, thus regulating the flow of pressurized oil from and towards the variable volume chamber 17*a* of the linear hydraulic actuator 10.

With reference to FIG. 2, in particular, the cylindrical cavity 19 is laterally defined by a cylindrical tubular liner 23 provided with three annular exhaust ports axially distributed along the cylindrical side wall of the liner itself.

The first exhaust port, hereinafter referred to by number 23*a*, is positioned at a distance da determined by the end surface of the cylindrical cavity 19 against which the slider 18 stops, or by the end surface 19*a*, and is connected to the variable volume chamber 17*a* inside the cylindrical cavity 17 via a first connection pipe. The second exhaust port, hereinafter indicated by number 23*b*, is positioned at a distance db determined by the end surface 19*a*, and is connected to the pressurized oil inlet 15*a* by means of a second connection pipe. Finally, the third exhaust port, hereinafter referred to by number 23*c*, is positioned at a distance dc determined by the end surface 19*a*, and is connected again to the variable volume chamber via a third connection pipe.

It should also be noted that the three distances da, db and dc are assessed parallel to the axis B and are progressively increasing.

A fourth exhaust port, hereinafter indicated by number 23*d*, is made directly on the end of the cylindrical cavity 19 where one end of the helical spring 20 rests. Said fourth exhaust port communicates directly with the pressurized oil outlet 15*b* via a fourth connection pipe.

With reference to FIG. 2, the slider 18 consists of a shaped piston which is fitted axially to move inside the cylindrical tubular liner 23 between a first operating position (see FIG. 2), in which it stops against the end surface 19*a* of the cylindrical cavity 19, and a second operating position (see FIG. 5), in which it is positioned at a maximum pre-set distance from the end surface 19*a*.

The slider 18, in particular, is fitted to move inside the fluid-tight cylindrical tubular liner 23, and is shaped in order to establish direct communication between the exhaust ports 23*c* and 23*d* and prevent the exhaust ports 23*a* and 23*b* being in direct communication with each other or with the exhaust port 23*d* when it is in the first operating position. The slider 18, furthermore, is shaped in order to prevent the exhaust ports 23*a*, 23*b* and 23*c* communicating with one another or with the exhaust port 23*d* when it is in the second operating position, and in such a way as to temporarily establish communication between the exhaust ports 23*a* and 23*b* during movement from the first to the second operating position.

In the example illustrated, in particular, the shaped piston 18 has an axial length L which approximates by effect the distance dc separating the third exhaust port 23*c* from the end surface 19*a* of the cylindrical cavity 19, and is provided with an annular slot 18*a* near the axial end facing the end surface 19*a* of the cylindrical cavity 19.

This annular slot 18*a* has a width G, measured parallel to the axis B, that approximates by excess the distance between the exhaust ports 23*a* and 23*b* (or approximates by excess the difference between the distances db and da), in order to temporarily establish direct communication between the exhaust port 23*a* and the exhaust port 23*b* during axial movement of the shaped piston 18 inside the cylindrical cavity 19.

The annular slot 18*a*, furthermore, is positioned on the shaped piston body 18 in such a way as to keep the exhaust ports 23*a* and 23*b* isolated from each other when the shaped piston 18 is in the first operating position. In other words, the annular slot 18*a* is positioned on the shaped piston body 18 in such a way as to face the exhaust port 23*a*, but not the exhaust port 23*b*, when the shaped piston 18 stops against the end surface 19*a* of the cylindrical cavity 19.

With reference to FIG. 2, it should furthermore be underlined that the annular slot 18*a* is positioned on the shaped piston body 18 so that, at the end of the piston stroke, it overshoots the exhaust port 23*a*, but without simultaneously facing the exhaust ports 23*b* and 23*c*, thus avoiding establishing direct communication between the two above-mentioned exhaust ports.

In the light of the above, when the slider 18 is in the first operating position, the variable volume chamber 17*a* of the linear hydraulic actuator 10 is in direct communication with the pressurized oil outlet 15*b* and the slide valve 12 is therefore in the first operating position.

When the slider 18 is in the second operating position, the variable volume chamber 17*a* of the linear hydraulic actuator 10 is isolated from the pressurized oil inlet 15*a* and outlet 15*b*, and the slide valve 12 is therefore in the second operating position.

During movement of the slider 18 from the first to the second operating position, the variable volume chamber 17*a* of the linear hydraulic actuator 10 temporarily communicates with the pressurized oil inlet 15*a* and the slide valve 12 is therefore in the third operating position.

Lastly, as regards the electric control actuator 14, with reference to FIG. 2, the cylindrical cavity 22 faces the axial end of the slider 18 facing the end surface 19*a*, and the piston 21 is fitted in the cylindrical cavity 22 in such a way that it partially protrudes outside the cavity so that it is positioned and remains with one end against the axial end of the slider 18.

The piston 21, furthermore, is fitted to move inside the fluid-tight cylindrical cavity 22 in order to create inside the latter a variable volume chamber 22*a* selectively designed to be filled with pressurized oil. This pressurized oil is able to exert on the piston 21 a force sufficient to overcome the action of the helical spring 20, or the elastic element 13, and to axially move the piston 21 from a retracted position, in which it protrudes outside the cylindrical cavity 22 by a set length K', to an extended position in which it protrudes outside the cylindrical cavity 22 by a set length K", greater than K'.

Also in this case it should be pointed out that the piston 21, as it is always against the axial end of the slider 18, sets the slider 18 to the first operating position when it is in the retracted position, whereas when it is in the extended position it sets the slider 18 to the second operating position. The difference between the lengths K' and K" corresponds to the stroke that the slider 18 can travel inside the cylindrical cavity 19.

As regards inflow and outflow of the pressurized oil to/from the variable volume chamber 22*a*, the electric control actuator 14 is provided with two solenoid valves with controlled opening and closing, fitted inside the outer casing 15, to regulate the pressurized oil inflow and outflow to/from the variable volume chamber 22*a*.

In the example illustrated, in particular, the electric control actuator 14 comprises two fuel injectors of known type, fitted in the outer casing 15 in such a way as to reach the variable volume chamber 22*a*. The first fuel injector, hereinafter indicated by number 25, has its spray nozzle facing towards the variable volume chamber 22*a*, and is designed to regulate the inflow of pressurized oil to the variable volume chamber 22*a*, while the second fuel injector (not visible as it is covered by the first one) faces in the opposite direction, or so that the spray nozzle faces away from the variable volume chamber 22, and is designed to regulate the outflow of pressurized oil from the variable volume chamber 22*a*.

It should be noted that the pressurized oil sent to the variable volume chamber 22*a* of the electric control actuator 14 can have a pressure different from the pressurized oil that is sent to the electrohydraulic device 1 through the inlet 15*a*. In this way, it is possible to regulate the lift of the valve 2 directly via the pressure value of the oil going into the electrohydraulic device 1 through the inlet 15*a*: as the pressure increases, the lift of the valve 2 of the engine increases.

Operation of the electrohydraulic device 1 by activation of the intake or exhaust valves 2 of a combustion engine will now be described with reference to FIGS. 2, 3, 4 and 5, assuming that the valve 2 is in the closed position, that the piston 16 is in the retracted position and that the piston 21 and the slider 18 are in the retracted position and the first operating position respectively.

When the command is given for opening of the fuel injector 25, the pressurized oil enters the variable volume chamber 22*a* of the electric control actuator 14 and gradually pushes the piston 21 out of the cylindrical cavity 22, overcoming the elastic force exerted by the helical spring 20, so that it moves the slider 18 from the first operating position.

In the initial part of the stroke of the slider 18, the exhaust port 23*c* is progressively closed by the body of the slider 18, while exhaust ports 23*a* and 23*b* are kept isolated from each other. In other words, in the initial part of the stroke of the slider 18, the variable volume chamber 17*a* of the linear hydraulic actuator 10 is kept in direct communication with the pressurized oil outlet 15*b*, and the piston 16 therefore remains in the retracted position, leaving the valve 2 in the closed position.

Figure 3:
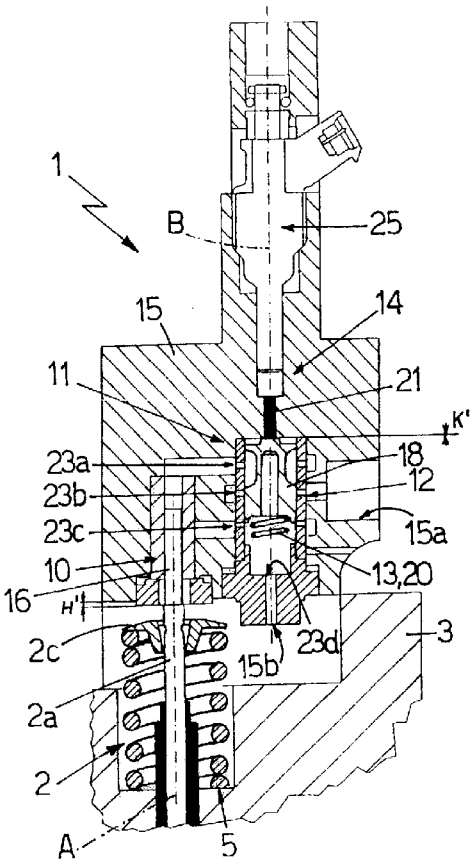

With reference to FIG. 3, at the end of this first part of the stroke of piston 21, the slider 18 has completely closed the exhaust port 23*c* and is about to establish communication between the exhaust ports 23*a* and 23*b*. At this moment, the variable volume chamber 17*a* of the linear hydraulic actuator 10 is isolated from the pressurized oil inlet 15*a* and outlet 15*b*.

Figure 4:
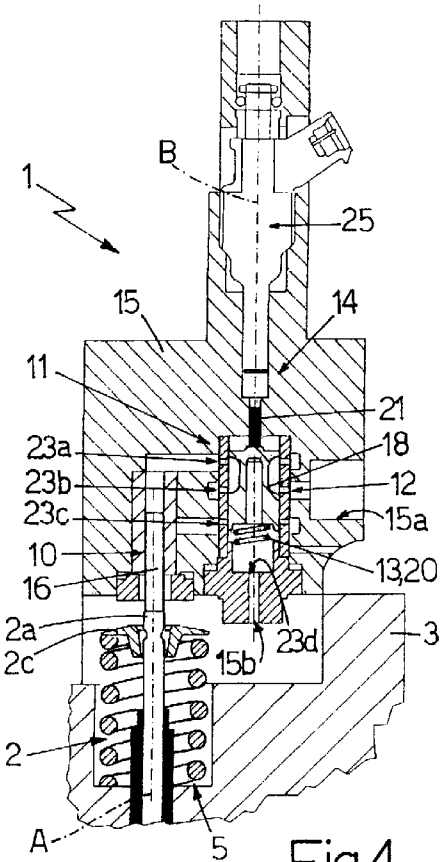

With reference to FIG. 4, in the middle part of the stroke of piston 21, the slider 18 establishes direct communication between the exhaust port 23*a* and the exhaust port 23*b* via the annular slot 18*a* and the pressurized oil can therefore reach the variable volume chamber 17*a* of the linear hydraulic actuator 10 and gradually push the piston 16 out of the cylindrical cavity 17, in order to gradually move the valve 2 from the closed position to the maximum opening position, overcoming the elastic force of the elastic element 5.

Figure 5:
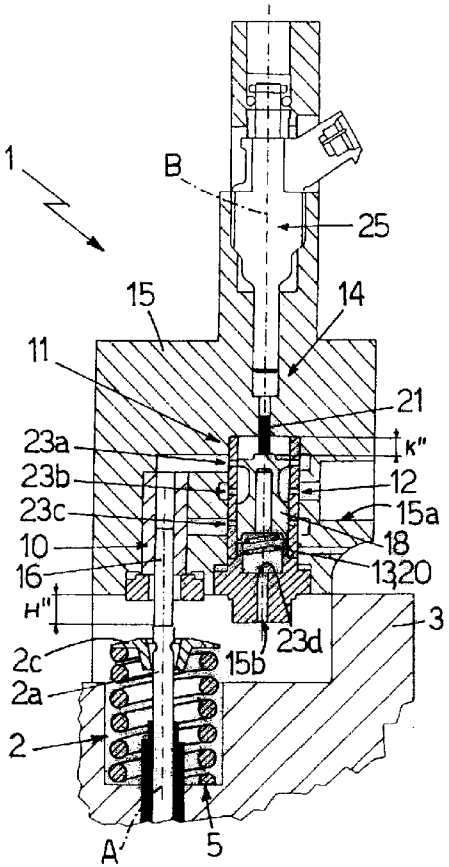
FIGS. 3, 4 and 5 illustrate in section the electrohydraulic device of FIG. 2 in three different operating positions.

With reference to FIG. 5, in the final part of the stroke of piston 21 that sets the piston 21 to the extended position and the slider 18 to the second operating position, the body of the slider 18 gradually closes the exhaust port 23*a*, until the variable volume chamber 17*a* of the linear hydraulic actuator 10 is completely isolated from the pressurized oil inlet 15*a*.

In this condition, the exhaust ports 23*a*, 23*b* and 23*c* are all closed by the body of the slider 18 and the pressurized oil can no longer enter or leave the variable volume chamber 17*a*: consequently the piston 26 remains blocked in the extended position and the valve 2 in the maximum opening position.

At this point, the fuel injector 25 is cut off, or closed, in order to block the piston 21 in the extended position.

The electrohydraulic device 1 can keep the valve 2 in the maximum opening position indefinitely until the other fuel injector is supplied, permitting outflow of the pressurized oil from the variable volume chamber 22*a* of the electric control actuator 14 and consequent gradual return of the slider 18 to the first operating position, pushed by the helical spring 20.

In the movement from the second to the first operating position, the slider 18 obviously permits re-pumping of the majority of the pressurized oil contained in the variable volume chamber 17*a* of the linear hydraulic actuator 10 towards the pressurized oil inlet 15*a*.

The electrohydraulic device 1 for activation of the intake or exhaust valves 2 has the considerable advantage of featuring a particularly simple structure that guarantees a high level of reliability in the long term, therefore permitting use in the automotive sector. Furthermore, the electrohydraulic device 1 is relatively inexpensive to produce.

Lastly it is clear that modifications and variations can be made to the electrohydraulic device 1 described here while remaining within the scope of the present invention.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An electrohydraulic device (1) for operating an intake or exhaust valve (2) of a combustion engine; the electrohydraulic device (1) comprises a linear hydraulic actuator (10) designed to move the valve (2) axially from a closed position to a maximum opening position, and an electronic control hydraulic distributor (11) designed to regulate the flow of pressurized liquid from and towards the linear hydraulic actuator (10) in order to control movement of the above-mentioned valve (2) between said closed and maximum opening positions; the electrohydraulic device (1) is characterized in that said electronic control hydraulic distributor (11) comprises a slide valve (12) which, by selection, can be set to three positions: a first operating position in which it establishes direct communication between said linear hydraulic actuator (10) and an outlet (15*b*) of the pressurized liquid, a second operating position in which it isolates said linear hydraulic actuator (10) in such a way as to prevent the flow of pressurized liquid from or towards the actuator, and a third operating position which establishes direct communication between said linear hydraulic actuator (10) and an inlet (15*a*) of the pressurized liquid.

2. The electrohydraulic device according to claim 1, characterized in that said electronic control hydraulic distributor (11) comprises electronic control movement devices (13, 14) designed, by selection, to move said slide valve (12) between said first, said second and said third operating position.

3. The electrohydraulic device according to claim 2, characterized in that said electronic control movement devices (13, 14) comprise an elastic element (13) designed to keep said slide valve (12) in the first operating position, and an electric control actuator (14) designed to move, by command, said slide valve (12) from said first operating position to said second operating position, overcoming the action of the elastic element (13); in the movement from said first to said third operating position, said electric control actuator (14) is designed to position said slide valve (12) in said third operating position.

4. The electrohydraulic device according to claim 2, characterized in that said slide valve (12) comprises an outer casing (15) and a slider (18) fitted axially to slide inside a first cylindrical cavity (19) which extends inside said outer casing (15); said first cylindrical cavity (19) is provided with a series of exhaust ports (23*a*, 23*b*, 23*c*, 23*d*) which communicate directly with said pressurized liquid inlet (15*a*), said pressurized liquid outlet (15*b*) and said linear hydraulic actuator (10); the slider (18) is fitted axially to slide inside said first cylindrical cavity (19) in such a way as to obstruct, according to its position inside the cavity, one or more of the above-mentioned exhaust ports (23*a*, 23*b*, 23*c*, 23*d*) in order to regulate the flow of pressurized liquid from and towards said linear hydraulic actuator (10).

5. The electrohydraulic device according to claim 4, characterized in that said elastic element (13) comprises a helical spring (20) positioned inside said cylindrical cavity (19) with the two ends resting against a first end surface of the first cylindrical cavity (19) and the axial end of the slider (18) respectively, in such a way as to keep the latter firmly resting against a second end surface (19*a*) of said first cylindrical cavity (19).

6. The electrohydraulic device according to claim 4, characterized in that said electric control actuator (14) comprises a second piston (21), fitted axially to slide inside a second fluid-tight cylindrical cavity (22) which extends inside said outer casing coaxially with said first cylindrical cavity (19) from said second end surface (19*a*) of the first cylindrical cavity (19), against which said slider (18) is pushed; said second piston (21) is fitted to move inside said second fluid-tight cylindrical cavity (22) in such a way as to define inside the latter a variable volume chamber (22*a*) selectively designed to be filled with pressurized liquid.

7. The electrohydraulic device according to claim 1, characterized in that said linear hydraulic actuator (10) comprises an outer casing (15) and a third piston (16) fitted axially to slide inside a third fluid-tight cylindrical cavity (17) which extends in the outer casing (15) coaxially with the stem (2*a*) of the valve (2) and faces the upper end of said stem (2*a*); said third piston (16) is fitted in the third cylindrical cavity (17) in such a way as to protrude partially outside the cavity, thus positioning itself and remaining always against the upper end of the stem (2*a*) of the valve (2), and is fitted to move inside said third fluid-tight cylindrical cavity (17) in such a way as to define inside the latter a variable volume chamber (17*a*) selectively designed to be filled with pressurized liquid.

* * * * *